United States Patent [19]

Unterberger

[11] 4,006,885

[45] Feb. 8, 1977

[54] MODULAR FENCE AND HAND RAIL

[76] Inventor: Jose Unterberger, 2562 Runyon, Anaheim, Calif. 92804

[22] Filed: Dec. 5, 1975

[21] Appl. No.: 638,145

[52] U.S. Cl. ..... 256/59; 403/296

[51] Int. Cl.[2] ..... E04H 17/14

[58] Field of Search ..... 256/21, 22, 24, 59, 256/65; 403/296

[56] References Cited

UNITED STATES PATENTS

| | | | |
|---|---|---|---|
| 288,459 | 11/1883 | Leet | 403/296 |
| 2,150,651 | 3/1939 | Ewing | 256/22 X |
| 2,655,345 | 10/1953 | Lindman | 256/22 |
| 3,150,460 | 9/1964 | Dees | 403/296 X |

*Primary Examiner*—Wayne L. Shedd

[57] ABSTRACT

A modular fence and hand rail designed to be assembled into connecting modular segments, thereby forming a continuous fence or railing. Said segments can be assembled in various lengths or heights by unskilled individuals. The modular segments comprise an upper railing and a lower railing with a plurality of removably attached vertical bars connecting the rails in a parallel relationship to each other. Anchor posts are attached to the ends of the rails to stabilize the segments and define the boundaries of the completed fence. Sufficient simplicity and variableness exist to enable a do-it-yourselfer to construct his own decorative fence which, in its metallic mode, is strong enough to resist entrance by children and animals into restricted and hazardous areas.

2 Claims, 6 Drawing Figures

MODULAR FENCE AND HAND RAIL

BACKGROUND OF THE INVENTION

1. Field of the Invention

This invention relates to fences and hand rails and, more particularly to modular fence segments which can be economically manufactured in a minimum number of individual components wherein various lengths or heights can be readily accommodated thereby.

2. Description of the Prior Art

As is well known in the art, various types of fences and railings are presently available. However, several problems and difficulties are encountered in providing fencing materials whereby an unskilled individual can construct a fence and/or railing without special tools and devices. Presently, skilled labor with the proper tools must be employed for the simplest construction. Thus, the expense of the most routine fence structure with its components becomes very burdensome for the average homeowner — particularly for those who are required by law to fence in swimming pools and the like.

Several patents have been issued relating to fence construction but none have proved satisfactory.

The following are some examples of such issued Patents.

Falendysh U.S. Pat. No. 1,488,199 described an iron fence which could be manufactured and shipped in component form. The construction he described was such that the components could be assembled and the entire fence erected by unskilled labor.

Falendysh's discloses a structure composed of post units each composed of a cap member, a base member and a body member and picket units comprised of cap members, base members and body members.

The post unit cap and base members have specially designed lugs as do the corresponding parts of the special picket members. These are interconnected using hinge pins. The picket members are interconnected with each other and with the special picket units by rails that pass through their cap and base members.

Thus the invention disclosed by Falendysh has post caps base and body members, special picket unit cap base and body members, standard picket unit cap, base and body members, rails and hinge pins. A total of ten different items must be tooled, manufactured and correctly assembled for shipment, then correctly assembled in order to "build" a unit of fence. This is a costly and inefficient method. Also the invention is limited in vertical height to the height of the body members. If variable height is desired various height picket body units must be manufactured which involves additional tooling and inventory costs.

The present invention is much simplified and teaches away from Falendysh in its basic construction. Only three individual components need to be tooled. With these three components and accompanying fasteners fences may be easily constructed of varying height and length.

Parker U.S. Pat. No. 1,784,107 discloses a means of attaching modular building units to each other by means of co-acting engagement elements on one member and notches on the mating part.

The present invention is simpler to manufacture, more pleasing in appearance and avoids Parkers claims and disclosure.

Miller U.S. Pat. No. 1,791,680 discloses a system of rails fastened together by locking rods through perforations in the end of the vertical rods and locking bars located in slots on the horizontal rails.

The present invention avoids the use of slots and bars and overcomes the limited use of Millers invention by enabling one to build multiple modules in a horizontal or vertical direction.

Yuen et al. U.S. Pat. No. 2,703,724 reveals a sectional construction kit utilizing bamboo. His invention is primarily directed to devices which can be seated in the hollow end members of bamboo and interconnect with each other to form a building structure.

None of these concepts or those disclosed by Verderio in U.S. Pat. No. 3,748,802 are utilized in the present invention which permits similar but improved results to be obtained.

SUMMARY OF THE INVENTION

The purpose of this invention is to provide a modular, decorative fence and hand rail which can be economically tooled and manufactured—then shipped in a knocked-down condition, whereby an unskilled individual can readily assemble the few components with the simplest of tools, such as a screw driver and pliers.

Hence, this invention concerns a modular, tubular fence comprising a pair of horizontal rails, one being an upper or top rail held in parallel position to a lower support rail by a plurality of equally spaced vertical bars in a typical fence-like manner. However, each bar is provided at its upper end with a threaded, extended screw adapted to be received in any one of the corresponding threaded holes in the lower surface of the top rail, its lower end being provided with a threaded insert plug. This plug abutts the lower rail in alignment with apertures disposed in the lower rail through which a threaded bolt is passed to engage the fixed plug. Once this is accomplished, an end post, also referred to as an anchor post, is attached to the opposite free ends of the horizontal rails. Thus, a complete segment is formed whereby other segments can be readily secured in an end-to-end operation, thereby allowing an individual to construct a fence in any given area in a very simple manner. Other elements such as base plates are included, the base plates being secured to the anchor post for attaching to a floor or foundation; and angle brackets are used to attach the anchor post to the rails.

It is also contemplated that, due to the construction of the bars, one bar can be attached to a second bar in a vertical position—with case and without special tools—thus creating a fence having a greater height.

OBJECTS AND ADVANTAGES OF THE INVENTION

The present invention has for an important object a provision whereby unskilled labor without specially designed tools can construct a firm, reliable fence or hand rail.

It is another object of the invention to provide a modular, decorative and strong fence which can be economically tooled, and manufactured and shipped in a knocked-down condition.

It is still another object of the invention to provide a modular fence and hand rail that is designed as a do-it-yourself kit wherein the finished construction simulates in appearance expensive wrought iron fences.

It is a further object of the invention to provide a modular fence and hand rail that is formed by adding constructed segments in a manner whereby the overall desired length thereof is easily assembled for the required security and decorative purposes.

A still further object of the invention is to provide a fence of this character that is simple and rugged in construction and additionally provides a relatively long working life.

It is still another object of the present invention to provide a device of this character that is easy to service and maintain.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
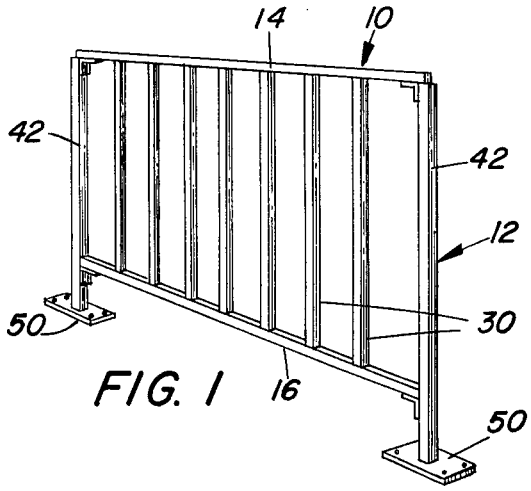
FIG. 1 is a perspective view of a single fence module.

Referring more particularly to the drawings, there is shown a modular fence and/or hand rail, generally indicated at 10. FIG. 1 illustrates a single modular segment designated generally at 12, by which the end-to-end joining of a plurality of these segments provide a continuous protected fence which can be formed for any desired location or situation. Thus, the construction can be accomplished by unskilled labor with very simple tools in a very short period of time.

Figure 2:
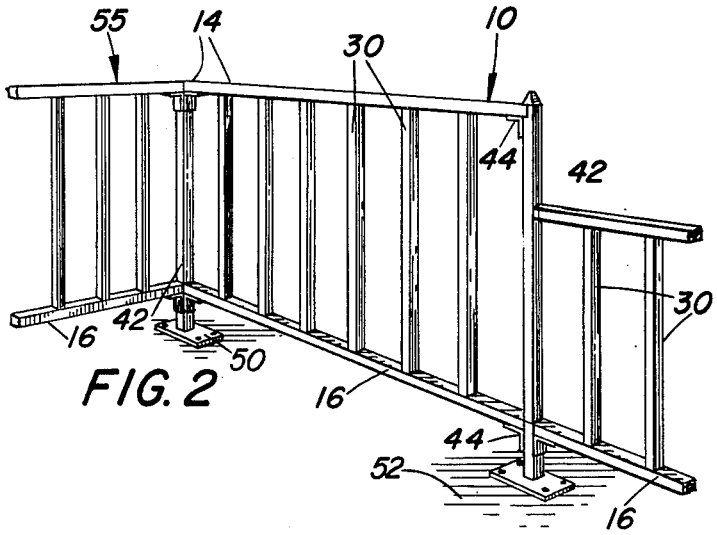
FIG. 2 is a perspective view of a multiple length fence, wherein a portion of the modular segments is reduced in height.
Figure 3:
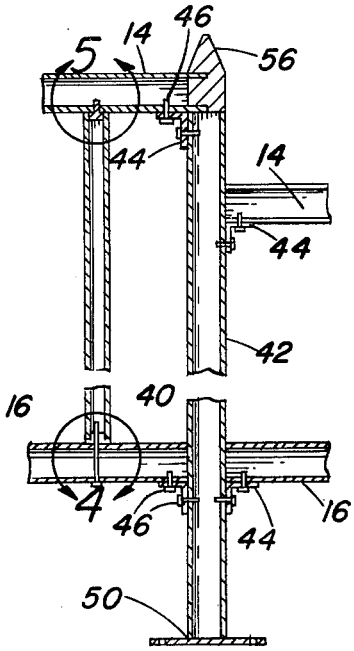
FIG. 3 is a fragmentary, cross-sectional view of a portion of the fence showing its connecting structure.
Figure 4:
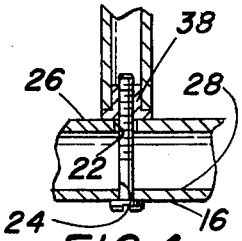
FIG. 4 is an enlarged cross-sectional view of the lower end of a vertical bar attached to the lower rail.

A single segment, as seen in FIG. 1, can be secured to other segments, as seen in FIG. 2, regardless of the height desired. Each segment comprises an upper or top rail member 14 and a lower support rail member 16. The upper rail member 14 will generally be formed from an elongated, substantially square, tubular member, wherein the lower surface wall 18 is provided with a plurality of equally-spaced, threaded holes 20. The lower support rail is also formed from an elongated, substantially-square, tubular member; however, this rail includes a plurality of equally spaced apertures 22 and 24 on two oppositely disposed walls 26 and 28, respectively, as seen in FIG. 4, said apertures 22 and 24 being axially aligned with each other.

Figure 5:
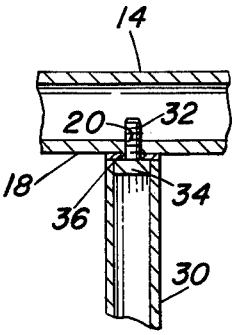
FIG. 5 is an enlarged, cross-sectional view of the upper portion of the vertical bar secured to the top rail thereof.

Accordingly, each segment 12 includes a plurality of vertical bar members 30 that are interdisposed between the upper and lower rails 14 and 16, thereby fixing said rails in a parallel relation to each other. Said vertical bars are removably attached to each rail, wherein the upper end of each vertical bar is provided with a threaded screw 32, as seen in FIG. 5, the screw having a head member 34 which is secured in the tubular opened end, said head 34 being fixed therein in any well known and suitable manner, such as force fitting or welding.

The bar 30 is simply rotated to allow screw 32 to enter threaded hole 20, wherein the threads are so arranged that the bar will always maintain a proper position relative to the rails. In addition, it is contemplated that a washer 36 may be used between the lower surface wall 18 and the upper end of bar 30.

Once all the bars 30 are secured to the upper rail 14, the lower support rail is then secured to said bars. This is accomplished due to the insert plug 38 which is mounted to the lower end of each bar, as seen in FIG. 4. Said insert plug is arranged with a threaded bore in which bolt 40 is received. Bolt 40 is passed through apertures 22 and 24 and then threaded to plug 38. This then provides a very-firm, rugged structure in a very simple manner, wherein only a screw driver is required until this point of the construction.

However, to complete a segment such as 12, there are provided two end posts or anchor posts 42. Said anchor posts 42 are positioned at each end of the rails 14 and 16, and are secured thereto by angle brackets 44, which are attached in any suitable manner; but it is contemplated that self-threading screws 46 will be used, whereby only simple holes will have to be drilled to receive each screw 46.

Thus, it becomes a simple matter to change the height of a continuous fence, as seen in FIG. 2.

Affixed to the lower end of each anchor post 42 is a base plate 50 which is attached thereto by any suitable means, such as welding. These base plates 50 are provided with holes to allow fastening bolts or the like to be inserted therethrough and attached to the floor 52 or foundation.

Thus, it can be understood that a continuous fence, having right or left turns, such as indicated at 55, can be very readily structured, by unskilled individuals, with the required number of segments.

Figure 6:
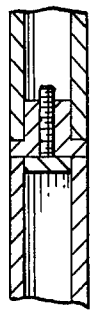
FIG. 6 is an enlarged, cross-sectional view illustrating the mounting of two vertical bars, one above the other.

In addition, it is contemplated that, under certain required conditions, higher fence protection is needed; and this can be accomplished by connecting a plurality of vertical bars 30 in an end-to-end mode, such as seen in FIG. 6. As an example, bars 30 could be three feet long and, by adding a second bar, the height becomes six feet in length.

To provide a completely safe fence, each upper exposed end of the anchor post 42 and the adjacent free end of the upper rail 14 is provided with a cap member 56.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. A modular fence and hand rail comprising:

a first upper, elongated, tubular rail member having a plurality of equally-spaced, threaded holes juxtapositioned along one side thereof;

a second, lower, support rail positioned in parallel relationship to said first rail, said second rail being an elongated tubular member having a plurality of oppositely aligned holes disposed therein in a juxtaposed relation;

a plurality of vertical, tubular bar members, wherein each bar includes;

a threaded screw secured to the upper end of said bar wherein said screw is arranged to be received in said threaded holes of said first rail member;

a threaded plug being removably attached to the lower end of said bar;

a mounting bolt adapted to pass through said aligned holes of said second rail, and threadably engage said threaded plug in said vertical bar;

a pair of anchor posts removably mounted to each end of said rails;

a base plate secured to said anchor post;

attached means comprising an angular bracket interconnecting said rails and anchor post for removably mounting thereto; and a cap member arranged to be secured to adjacent terminating open ends of said first upper rail and said anchor post, whereby said ends are closed thereby.

2. A modular fence and hand rail as recited in claim 1, wherein said vertical bar members are arranged to be interconnected to an end-to-end mode, whereby a desired change of height can be attained.

* * * * *